United States Patent [19]

Bourboulis

[11] 4,059,092

[45] Nov. 22, 1977

[54] HEAT DEFLECTOR

[76] Inventor: Cedric D. Bourboulis, 34 Fountainhead Court, Martinez, Calif. 94533

[21] Appl. No.: 736,981

[22] Filed: Oct. 29, 1976

[51] Int. Cl.[2] ..... F24C 15/10

[52] U.S. Cl. ..... 126/215

[58] Field of Search ..... 126/214 R, 214 C, 214 D, 126/215, 27, 50, 220

[56] References Cited

U.S. PATENT DOCUMENTS

| | | | |
|---|---|---|---|
| 989,399 | 4/1911 | Morton | 126/215 |
| 1,090,045 | 3/1914 | Gladden | 126/215 |
| 1,164,066 | 12/1915 | Staebler | 126/215 |
| 1,613,534 | 1/1927 | Rice | 126/220 |
| 2,030,519 | 2/1936 | Hamilton | 126/215 |
| 2,593,003 | 4/1952 | Block | 126/215 |

*Primary Examiner*—Edward G. Favors

*Attorney, Agent, or Firm*—Townsend and Townsend

[57] ABSTRACT

A heat deflector for distributing the heat from a heat source relatively uniformly over the lower surface of a large or small cooking utensil is disclosed. The apparatus includes a plurality of concentric annular elements each including an upwardly concave dish-shaped annulus. Each annular element is constructed of heat conductive material, and the interior edges of the respective elements are fixed to the convolutions of a wire to mount the elements in a concentric configuration. The heat deflector can be placed on the heat source with the wire down to distribute the heat therefrom relatively evenly over the lower surface of a cooking utensil which is large relative to the heat source. Alternatively, the heat deflector can be placed on the heat source with the wire up to concentrate the heat from the heat source relatively evenly over the lower surface of a cooking utensil which is small relative to the heat source. In either event, the heat from the heat source is efficiently and effectively distributed throughout the entire lower surface of the cooking utensil.

7 Claims, 6 Drawing Figures

HEAT DEFLECTOR

BACKGROUND OF THE INVENTION

The present invention relates to apparatus for distributing the heat from the heat source relatively uniformly over the lower surface of a cooking utensil.

One of the problems involved in cooking on a stove is distributing the heat relatively uniformly over the lower surface of a cooking utensil, especially when the cooking utensil is much larger or smaller than the source of heat. When a cooking utensil is used which is large relative to the heat source, the heat is concentrated in the center of the cooking utensil and the outer periphery of the heating cooking utensil receives little or no heat. This is a particular problem when food is to be simmered in a large pot at low heat because the food at the center of the pot can be scorced while the outer periphery of the pot receives virtually no heat whatsoever. Conversely, when a cooking utensil is used which is small relative to the heat source, the heat emanating from the heat source around its periphery is wasted.

The problem described above is most acute when an electric stove is used, or when a gas stove is used at low heat. A gas flame at relatively high levels has the capability of adapting itself to the size of the pot because the flame wraps itself around the lower surface of the pot. However, the dimensions of the heating element of an electric stove are fixed by the circumference of the heating coil used. Also, when a gas stove is operated with a small flame, e.g., to simmer foods at low heat, the flame is unable to adapt itself to the size of the cooking utensil and the problem of obtaining even heat distribution over the bottom of the cooking utensil is generally the same as that involved in using an electric stove.

SUMMARY OF THE INVENTION

The present invention provides a heat deflector for distributing the heat from a heat source relatively uniformly over the lower surface of a large or small cooking utensil. The apparatus includes a plurality of concentric annular elements each including an upwardly concave dish-shaped annulus. Each annular element is constructed of heat conductive material, and the interior edges of the respective elements are fixed to the convolutions of a wire to mount the elements in a concentric configuration.

The heat deflector of the present invention can be placed on the heat source with the wire down to distribute the heat therefrom relatively evenly over the lower surface of a cooking utensil which is large relative to the heat source. Alternatively, the heat deflector can be placed on the heat source with the wire up to concentrate the heat from the heat source relatively evenly over the lower surface of a cooking utensil which is small relative to the heat source. In either event, the heat from the heat source is efficiently and effectively distributed throughout the entire lower surface of the cooking utensil.

The present invention is very effective in simmering dishes such as chioppino for long periods of time at a low heat in relatively large pots. The pots used for such dishes are often much larger than the heat source, and because of the low heat, it is difficult to provide any appreciable heat to the outer periphery of the pot, which is not located directly over the heat source, without scorching the food at the center. The present invention serves to direct the heat outwardly to uniformly distribute the heat over the entire bottom of the cooking utensil so that the contens thereof will be uniformly heated.

When using the apparatus of the present invention with relatively small cooking utensils, the heat source can be operated at a lower output level. The heat output from the heat source is concentrated uniformly along the bottom of the cooking utensil so that heat energy is not wasted.

The novel features which are characteristic of this invention, both as to organization and method of operation, together with further objects and advantages thereof will be better understood from the following description in connection with the accompanied drawings which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
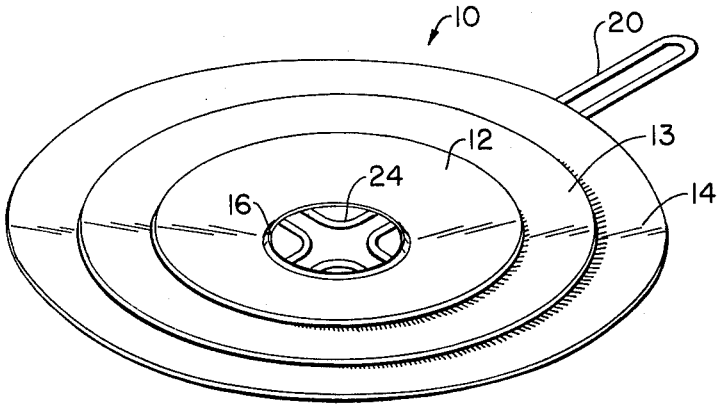
FIG. 1 is a perspective view of one embodiment of the present invention adapted primarily for use with electric stoves.
Figure 2:
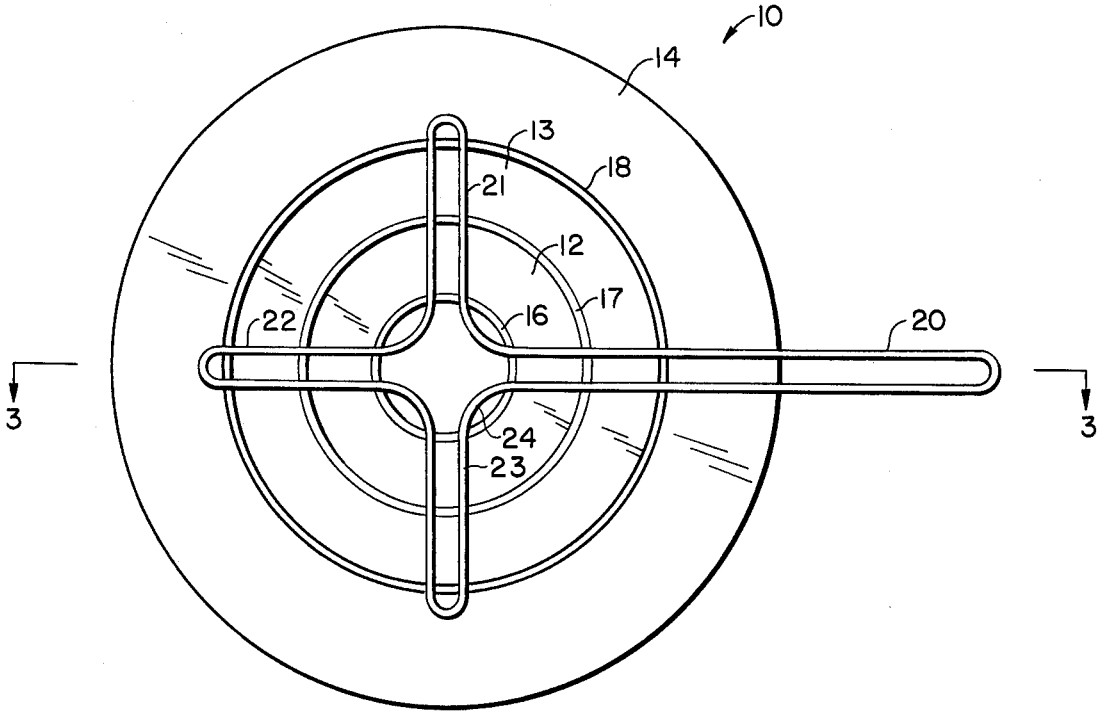
FIG. 2 is a bottom plan view of the embodiment of FIG. 1.
Figure 3:
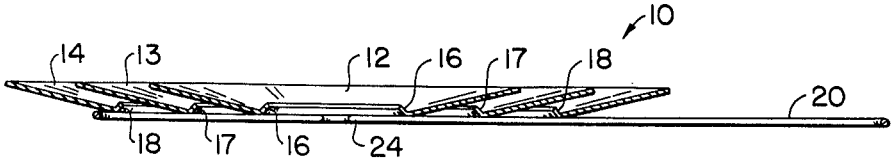
FIG. 3 is a section view taken along lines 3—3 of FIG. 2.
Figure 4:
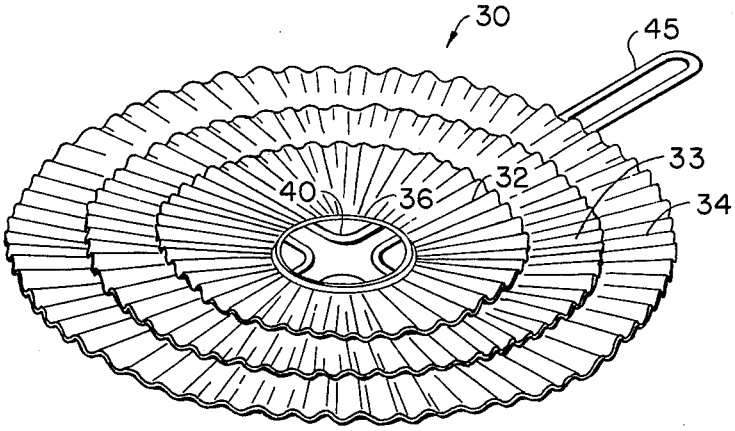
FIG. 4 is a perspective view of a second embodiment of the present invention adapted primarily for use with gas stoves.
Figure 5:
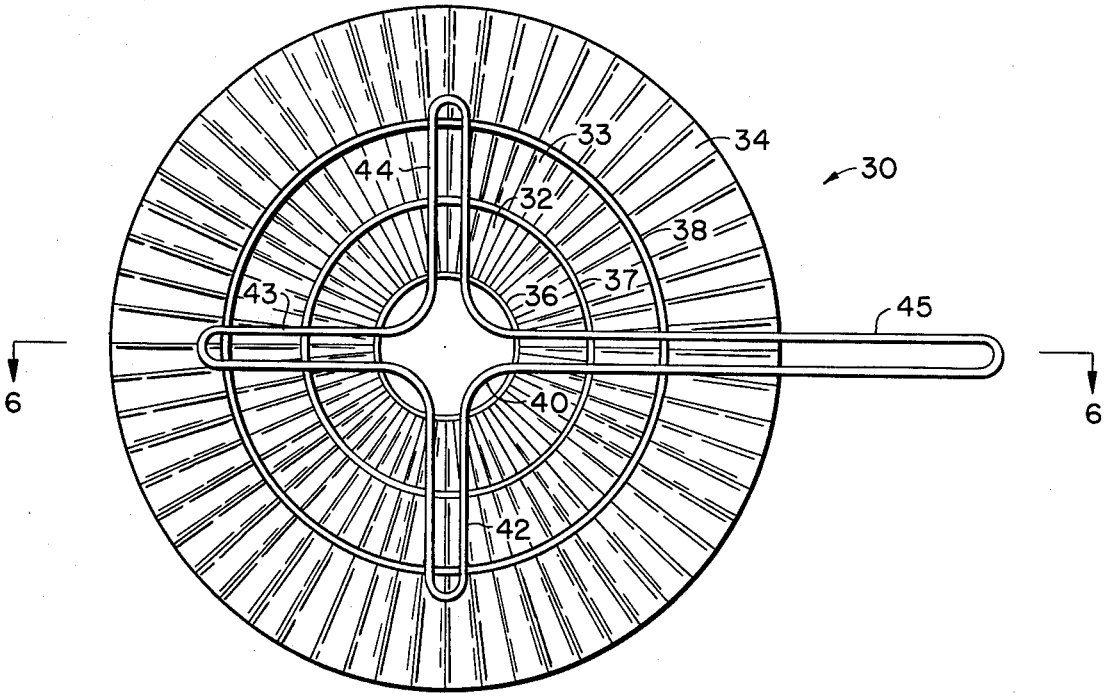
FIG. 5 is a bottom plan view of the embodiment of FIG. 4.
Figure 6:
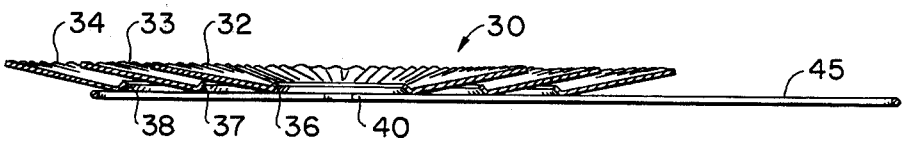
FIG. 6 is a section view taken along lines 6—6 of FIG. 5.

A heat deflector 10 comprising the first embodiment of the present invention is illustrated generally by reference to FIGS. 1—3 in combination. Heat deflector 10 is adapted to be used primarily on electric stoves or other heating appliances which do not have an open flame. For stoves having an open flame, the second embodiment of the present invention described in FIGS. 4–6, is preferred, as discussed in detail hereinafter.

Heat deflector 10 includes a plurality of annular dish-shaped elements 12–14. Each dish-shaped element 12–14 has a hollow center, and an upwardly raised lip 16–18 along its interior edge which prevents warping of the element. The interior edges 16–18 of elements 12–14 are welded or otherwise fixed to the convolutions 20–23 in a wire 24. The convolutions 20–23 in wire 24 are distributed in a generally planar array so that the various dish-shaped elements 12–14 can be attached to the wire at several locations. One convolution 20 is extended to provide a handle for manipulating the element.

Each of the dish-shaped elements 12–14 is constructed of heat conductive material. Heat deflector 10 can be placed on a heating element (not shown) with the wire 20 down when a large cooking utensil is being used. The heat from the heating element will be distributed by dish- shaped elements 12–14 over a larger area than the area of the heating element itself, and will be substantially uniformly distributed over the lower surface of the cooking utensil.

When a relatively small cooking utensil is to be used, heat deflector 10 can be placed over the heat source with wire 20 up. Elements 12–14 will then serve to concentrate the heat from the heat source over a smaller area than that of the heat source. The concentrated heat will be distributed relatively evenly over the lower surface of the small cooking utensil, and will not be wasted.

Heat deflector 30 representing the second embodiment of the present invention is illustrated by way of reference to FIGS. 4–6. Heat deflector 30 includes a plurality of dish-shaped elements 32–34 which are similar to elements 12–14 in embodiment 10, but which have fluted outer edges as illustrated. The fluted outer edges of elements 32–34 allow dead air to escape when an open flame is being used, and thus heat deflector 30 is designed for use primarily with gas stoves. Each dish-shaped element 32–34 has a raised lip 36–38 respectively around its interior edge to prevent warping.

A wire 40 having a plurality of convolutions 42–45 is welded or otherwise fixed to elements 32–34 at their interior edges to mount the elements to the wire. One convolution 45 of wire 40 can be relatively longer than the others to provide a handle.

Heat deflector 30 can be used in the same manner as embodiment 10 to distribute heat from a heat source. If a cooking utensil is used which is large relative to the heat source, deflector 30 is positioned with the wire down so that the heat will be distributed over the bottom of the relatively large cooking utensil. If a cooking utensil is used which is small relative to the heat source, heat deflector 30 is located with the wire up to concentrate the heat and distribute it uniformly over the bottom of the relatively small cooking utensil.

While preferred embodiments of the present invention have been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. Apparatus for distributing the heat from a heat source relatively uniformly over the lower surface of a cooking utensil, said apparatus comprising:

a plurality of concentric annular elements each including an upwardly concave dish-shaped annulus circumscribing a hollow center, each said element being constructed of heat conductive material; and a wire having a plurality of convolutions in a generally planar array, the interior edges of the annular elements being fixed to the convolutions of the wire to mount the annular elements in a concentric configuration to the wire so that the wire together with the annular elements can be laid over a heat source with the wire down to distribute the heat therefrom evenly over the lower surface of a cooking utensil which is large relative to the heat source and is placed on top of the annular elements, or the wire together with the annular elements can be laid over a heat source with the wire up to concentrate the heat therefrom evenly over the lower surface of a cooking utensil which is small relative to the heat source and is placed on top of the annular elements.

2. Apparatus as recited in claim 1 wherein each of the annular elements includes an upwardly directed lip at the interior edge thereof to minimize warping of said elements.

3. Apparatus as recited in claim 1 wherein the wire includes a projection extending outwardly with respect to the annular elements to provide a handle.

4. Apparatus as recited in claim 1 wherein each of the annular elements has a fluted outer edge to allow dead air to escape from an open flame.

5. Apparatus for distributing the heat from a heat source relatively uniformly over the lower surface of a cooking utensil, said apparatus comprising:

a plurality of concentric annular elements each including an upwardly concave dish-shaped annulus circumscribing a hollow center, each said element being constructed of heat conductive material and having a fluted outer edge to allow dead air to escape from an open flame; and a wire having a plurality of convolutions in a generally planar array, the interior edges of the annular elements being fixed to the convolutions of the wire to mount the annular elements in a concentric configuration to the wire so that the wire together with the annular elements can be laid over a heat source with the wire down to distribute the heat therefrom evenly over the lower surface of a cooking utensil which is large relative to the heat source and is placed on top of the annular elements, or the wire together with the annular elements can be laid over a heat source with the wire up to concentrate the heat therefrom evenly over the lower surface of a cooking utensil which is small relative to the heat source and is placed on top of the annular elements.

6. Apparatus as recited in claim 5 wherein each of the annular elements includes an upwardly directed lip at the interior edge thereof to minimize warping of said elements.

7. Apparatus as recited in claim 5 wherein the wire includes a projection extending outwardly with respect to the annular elements to provide a handle.

* * * * *